US009604478B1

(12) United States Patent
Montfort et al.

(10) Patent No.: US 9,604,478 B1
(45) Date of Patent: Mar. 28, 2017

(54) PRINT MEDIA BEAM STRENGTH SENSOR

(71) Applicant: Xerox Corporation, Norwalk, CT (US)

(72) Inventors: David B. Montfort, Webster, NY (US); Barry K. Ayash, Webster, NY (US); Mark Rule, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 15/183,829

(22) Filed: Jun. 16, 2016

(51) Int. Cl.
*B41J 11/00* (2006.01)
*B41J 13/00* (2006.01)

(52) U.S. Cl.
CPC ..... *B41J 13/0009* (2013.01); *B41J 11/0005* (2013.01)

(58) Field of Classification Search
CPC B41J 11/0005; B41J 11/0095; B41J 13/0009; G03G 15/5029; G03G 15/6561; G03G 15/6576; G03G 15/70; G03G 2215/00548; G03G 2215/00603; G03G 2215/00662; G03G 2215/00721; B65H 2220/01; B65H 2511/17; B65H 2513/511
See application file for complete search history.

(56) References Cited

U.S. PATENT DOCUMENTS

| | | | | |
|---|---|---|---|---|
| 5,934,140 | A | 8/1999 | Jackson et al. | |
| 6,055,409 | A | 4/2000 | Richards et al. | |
| 6,115,127 | A | 9/2000 | Brodeur et al. | |
| 6,356,846 | B1 | 3/2002 | Habeger, Jr. et al. | |
| 6,581,456 | B1 | 6/2003 | Clark | |
| 6,668,155 | B1 * | 12/2003 | Hubble, III | G03G 15/6576 162/197 |
| 7,545,519 | B2 | 6/2009 | Ossman et al. | |
| 7,690,248 | B2 | 4/2010 | Moore | |
| 8,346,154 | B2 * | 1/2013 | Hara | G03G 15/6561 399/18 |
| 8,795,571 | B2 * | 8/2014 | Bryl | B65H 23/34 264/280 |
| 2005/0097950 | A1 | 5/2005 | Singh et al. | |
| 2011/0064424 | A1 | 3/2011 | Knausdorf et al. | |
| 2011/0305490 | A1 | 12/2011 | Richards et al. | |
| 2012/0148322 | A1 | 6/2012 | de Jong | |

OTHER PUBLICATIONS http://www1.eere.energy.gov/manufacturing/resources/forest/pdfs/laser_ultrasonics.pdf, pp. 1-2, Jun. 14, 2016.

* cited by examiner

*Primary Examiner* — Anh T. N. Vo
(74) *Attorney, Agent, or Firm* — Gibb & Riley, LLC

(57) ABSTRACT

Beam strength and curl characteristics of sheets of print media change based not only on paper weight, but also on environmental conditions, such as humidity. Printers herein include a printing engine positioned to receive sheets of print media from a storage container. Sheet transport elements are positioned to transport the sheets from the storage through the printing engine. A sensor contacts one of the sheets, and the sensor detects a beam strength and curl characteristics signature profile of the sheet tested. Then, a processor (that is electrically connected to the sensor and the sheet transport elements) adjusts how the sheet transport elements contact the sheets (adjusts the angle, speed of, and force applied by, the sheet transport elements) based on the beam strength and curl characteristics signature profile.

20 Claims, 9 Drawing Sheets

PRINT MEDIA BEAM STRENGTH SENSOR

BACKGROUND

Systems and methods herein generally relate to printing devices, and more particularly to printing devices that can print on different types of paper, and different weight papers.

Printing devices have the ability to print on many different types of print media including paper, transparencies, plastic, card stock, etc. In order to accommodate the different thicknesses, different surface textures, different curling characteristics, etc., of different forms and weights of print media, the various sheet feeding devices (e.g., rollers, nips, belts, baffles, etc.) within the printing device are adjusted so that each different type of print media will move at the correct velocity, contact the printing elements properly, and will not become jammed within the printer.

In one example, as the user loads print media into the paper tray or other media storage compartment of the printer, the user can manually indicate the size, weight, and other print media characteristics of the print media they are loading (or such characteristics can be automatically determined). Often, this is done by having the user select from a list of allowable media types and sizes presented on the graphic user interface of the printer, or associated equipment. The printer then automatically adjusts the various rollers, nips, belts, baffles, etc., to previously established parameters to cause such sheet feeding devices to move at specific velocities and to apply specific pressures when contacting the print media. Such parameters can be previously established based upon empirical testing, modeling, etc.

SUMMARY

Beam strength and curl characteristics of sheets of print media change based not only on paper type and weight, but also on environmental factors such as humidity. Printers herein include a printing engine positioned to receive sheets of print media from a storage container that is shaped to store such sheets. Sheet transport elements are positioned to transport the sheets from the storage to the transfer nip of the printing engine.

A sensor contacts one or more of the sheets in the storage container, and the processor calculates the "beam strength and curl characteristics signature profile" of the sheet tested by the sensor based on the forces detected by the sensor. For example, the sensor can include a roller or other protrusion that presses against the sheet being tested to detect the force used to deform the sheet.

Potentially, the sensor only tests the beam strength and curl characteristics of a single one of the sheets (e.g., the top sheet) in the storage container, and performs such testing before printing occurs (and not during printing). In other situations, the testing can be performed during printing. After testing, the processor (that is electrically connected to the sensor and the sheet transport elements) adjusts how the sheet transport elements contact the sheets (adjusts how the sheet transport elements direct the sheets into the transfer nip, and adjusts the speed of, and force applied by, the sheet transport elements) during printing based on the calculated beam strength and curl characteristics signature profile.

In some cases, before any printing occurs, the sheet transport elements move the sheet being tested from the storage container to the sensor before the sensor detects the beam strength and curl characteristics signature profile, and the sheet transport elements move the sheet being tested back to the storage container after the sensor detects the beam strength and curl characteristics signature profile. The sensor can be an assembly that includes actuators that move the sensor toward and away from the storage container during a testing cycle. The sensor can be adjusted to not be aligned with the sheet transport elements during printing to avoid making any deformation of the sheet being printed upon, or the sensor can be aligned with the sheet transport elements during printing to allow continuous beam strength and curl characteristics signature profile to be detected while printing.

Presented in method form, the sheet transport elements partially remove a sheet of media from the storage container storing the sheets of media, and the sensor moves to contact the sheet while the sheet is held by the sheet transport elements (and is partially removed from the storage container). The sensor detects forces from the sheet contacting the sensor while the sheet transport elements move a portion of the sheet past the sensor (the sensor deforms the sheet when detecting the forces). Thus, the sensor is aligned with the sheet transport elements when the sensor detects the forces; however, the sensor automatically moves to not be aligned with the sheet transport elements after the sensor detects the forces (and the sensor may detect the forces of only one of the sheets in the storage container). At the same time, the sheet transport elements return the sheet to the storage container (after the sensor detects the forces). Simultaneously, the processor determines the beam strength and curl characteristics signature profile of the sheets based on the forces detected by the sensor.

During printing, the sheet transport elements transport the sheets from the storage container to the transfer nip of the printing engine after the sheet transport elements return the sheet to the storage container. In such methods, the sheet transport elements automatically adjust the angle at which the sheet transport elements direct the sheets into the transfer nip, as controlled by the processor, based on the beam strength and curl characteristics signature profile. Further, the sheet transport elements can also automatically adjust the speed of, and force applied by, the sheet transport elements, as controlled by the processor, based on the beam strength and curl characteristics signature profile.

These and other features are described in, or are apparent from, the following detailed description.

BRIEF DESCRIPTION OF THE DRAWINGS

Various exemplary systems and methods are described in detail below, with reference to the attached drawing figures, in which.

DETAILED DESCRIPTION

As mentioned above, various sheet feeding devices (e.g., rollers, nips, belts, baffles, etc.) within a printing device are adjusted to previously established parameters based on automatically-identified or user-identified media type, media size, media weight, etc., so that each different type of print media will move at the correct velocity and not become jammed within the printer. However, this can limit the print media that can be used with a printing device to only those types of print media that have been previously established or approved for that printer. In addition, changes in environmental conditions (e.g., changes in humidity, etc.) can alter the characteristics of the print media, which may cause the print media to unexpectedly travel at incorrect angles, move at undesired velocities, or have excessive curl characteristics.

Therefore, the systems and methods herein provide methods and systems that determine the beam strength of the print media independently of the media type or weight (and without measuring atmospheric conditions) by physically testing one of the sheets in the media storage immediately before printing occurs (or potentially during printing). More specifically, the methods and systems herein perform a "paper beam strength" test routine prior to the start of a print job, where the top paper in the paper drawer is engaged and translated across a force gauge (sensor) a fixed distance, and then returned to the media tray.

The force gauge is moved to a predetermined distance into the media path to measure the force occurring during movement of the media sheet, and then retracted to avoid interference with sheet movement during printing operations. The output signal from the force sensor provides a profile/signature characteristic of the beam strength as well as paper curl. The beam strength information is processed by the controller to optimize the operating parameters of the rollers, nips, belts, baffles, etc.

The configuration of the various sheet feeding devices is used to maintain good image quality, especially for the lead and trail edge of the sheet. Heavy weight papers typically have high beam strength, but not always, and therefore using a presumption of high beam strength for heavy weight papers can result in unexpected print defects and paper jams. In turn, paper curl is greatly affected by humidity (environmental storage conditions) and such humidity also affects image quality. Paper curl can be either concave or convex, and each can be compensated for using different sheet feeding device parameters.

Figure 1:
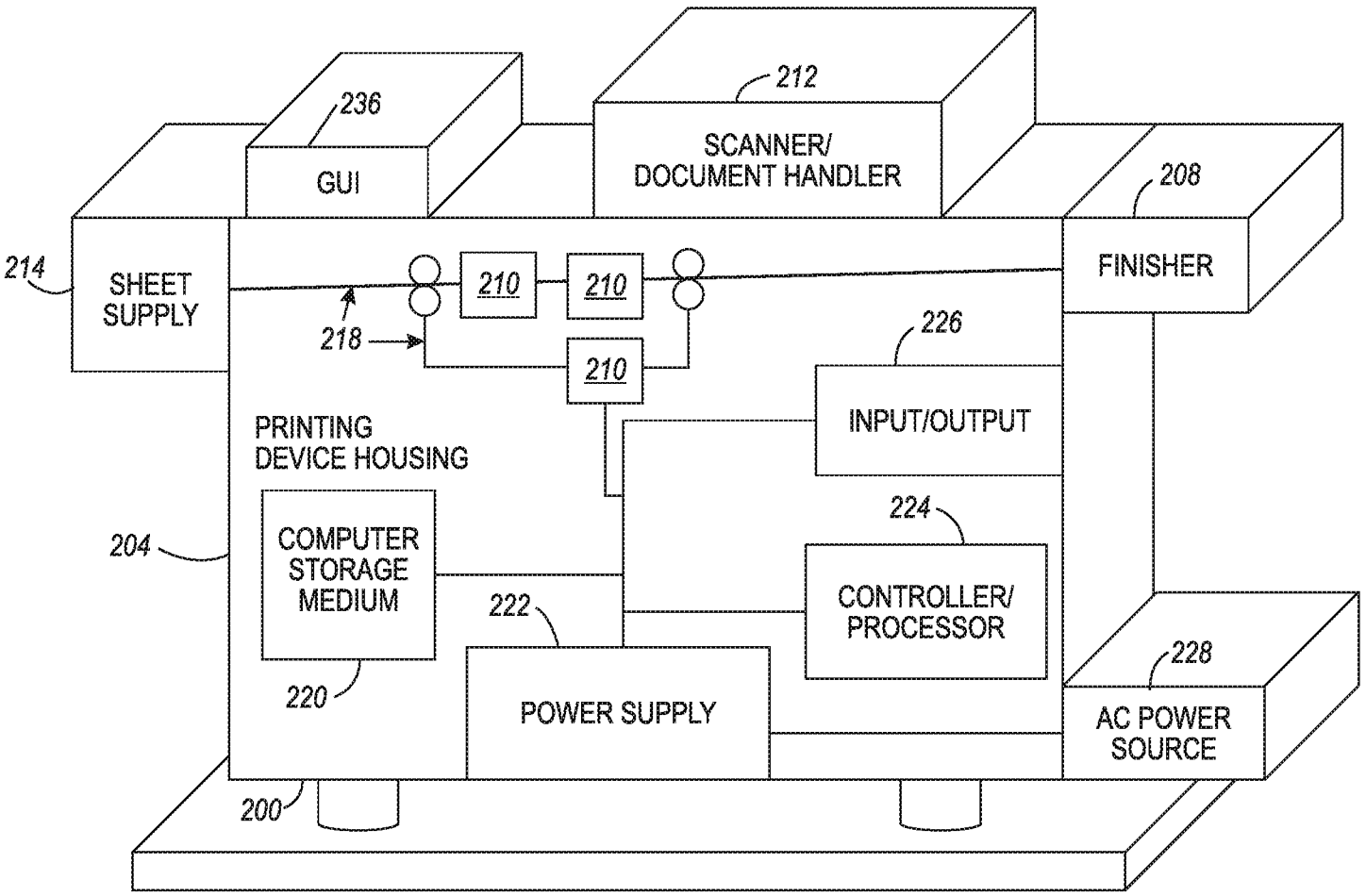
FIG. 1 is a schematic diagram illustrating printing devices herein.

FIG. 1 illustrates many components of printer structures 204 herein that can comprise, for example, a printer, copier, multi-function machine, multi-function device (MFD), etc. The printing device 204 includes a controller/tangible processor 224 and a communications port (input/output) 226 operatively connected to the tangible processor 224 and to a computerized network external to the printing device 204. Also, the printing device 204 can include at least one accessory functional component, such as a graphical user interface (GUI) assembly 236. The user may receive messages, instructions, and menu options from, and enter instructions through, the graphical user interface or control panel 236.

The input/output device 226 is used for communications to and from the printing device 204 and comprises a wired device or wireless device (of any form, whether currently known or developed in the future). The tangible processor 224 controls the various actions of the printing device 204. A non-transitory, tangible, computer storage medium device 220 (which can be optical, magnetic, capacitor based, etc., and is different from a transitory signal) is readable by the tangible processor 224 and stores instructions that the tangible processor 224 executes to allow the computerized device to perform its various functions, such as those described herein. Thus, as shown in FIG. 1, a body housing has one or more functional components that operate on power supplied from an alternating current (AC) source 228 by the power supply 222. The power supply 222 can comprise a common power conversion unit, power storage element (e.g., a battery, etc), etc.

The printing device 204 includes at least one marking device (printing engine(s)) 210 that use marking material, and are operatively connected to a specialized image processor 224 (that is different than a general purpose computer because it is specialized for processing image data), a media path 218 is positioned to supply continuous media or sheets of media from a sheet supply 214 to the marking device(s) 210, etc. After receiving various markings from the printing engine(s) 210, the sheets of media can optionally pass to a finisher 208 which can fold, staple, sort, etc., the various printed sheets. Also, the printing device 204 can include at least one accessory functional component (such as a scanner/document handler 212 (automatic document feeder (ADF)), etc.), a humidity/temperature sensor 232, etc., that also operate on the power supplied from the external power source 228 (through the power supply 222).

The one or more printing engines 210 are intended to illustrate any marking device that applies marking material (toner, inks, plastics, organic material, etc.) to continuous media, sheets of media, fixed platforms, etc., in two- or three-dimensional printing processes, whether currently known or developed in the future. The printing engines 210 can include, for example, devices that use electrostatic toner printers, inkjet printheads, contact printheads, three-dimensional printers, etc. The one or more printing engines 210 can include, for example, devices that use a photoreceptor belt or an intermediate transfer belt or devices that print directly to print media (e.g., inkjet printers, ribbon-based contact printers, etc.).

Figure 2:
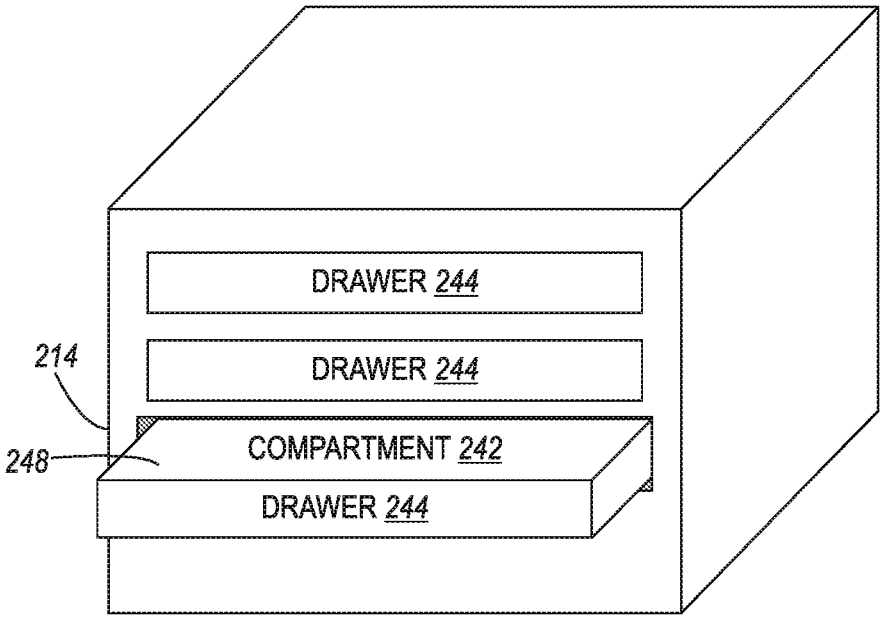
FIG. 2 is a schematic diagram illustrating portions of the sheet supply shown in FIG. 1.
Figure 3:
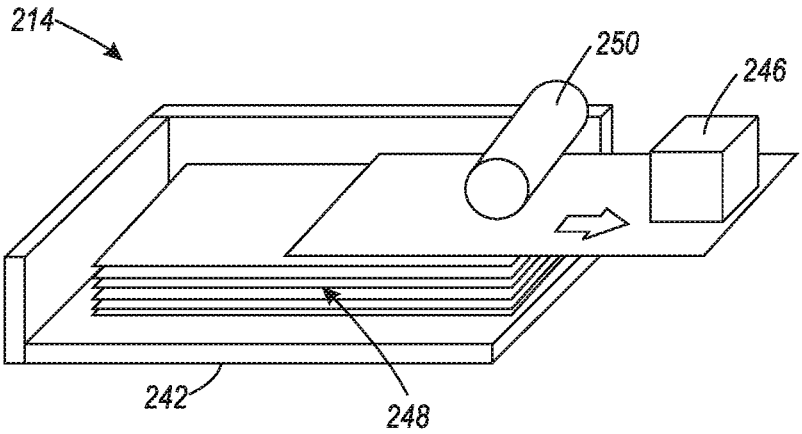
FIG. 3 is a schematic cut-away diagram illustrating the sheet supply shown in FIG. 1.

Thus, the printing engine 210 is positioned to receive sheets of print media from a storage container 214 (e.g., drawer 244 having a compartment 242 containing sheets of print media 248, as shown in FIGS. 2 and 3) that is shaped to store such sheets 248. Sheet transport elements 250 are positioned to transport the sheets 248 from the storage through the printing engine 210.

As shown in partial cut-away view in FIG. 3, a force sensor 246 contacts one of the sheets 248 that is still partially in the storage container 242, and the sensor 246 detects forces used to calculate the "beam strength and curl characteristics signature profile" of the sheet tested. For example, the sensor 246 can include a roller that presses against the sheet being tested to detect the force used to deform the sheet. Potentially, the sensor 246 only tests the beam strength and curl characteristics of a single one of the sheets 248 (e.g., the top sheet) in the storage container 242 before printing occurs (and not during printing). Then, the processor 224 (that is electrically connected to the sensor 246 and the sheet transport elements) calculates the beam strength and curl characteristics signature profile and adjusts how the sheet transport elements contact the sheets 248 (adjusts how the sheet transport elements direct the sheets into the transfer nip, and adjusts the speed of, and force applied by, the sheet transport elements) during printing based on the calculated beam strength and curl characteristics signature profile.

Figure 4A:
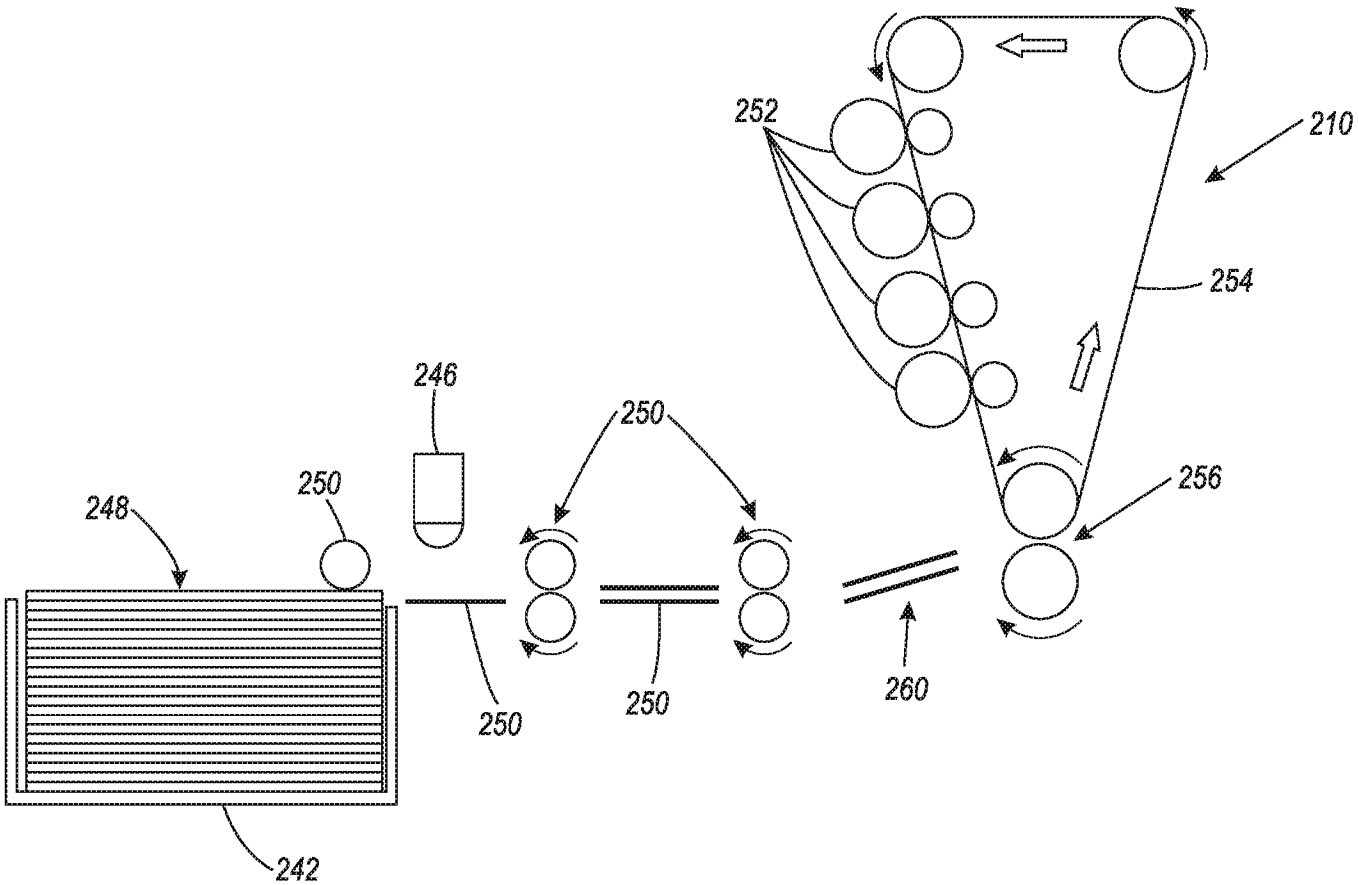
FIGS. 4A-4E are side-view schematic diagrams illustrating the operation of the devices herein.

FIGS. 4A-4E show a partial side view of the sheets 248, force sensor 246, sheet transport elements 250, an adjustable baffle 260, and printing engine 210 shown in FIGS. 1-3. As shown in FIGS. 4A-4E, the printing engine 210 can include (in one example) an intermediate transfer belt 254 moving past development devices 252 and a transfer nip 256 where marking material is transferred to each sheet 248. FIG. 4A illustrates the structure before beam strength testing or printing is performed (while such is not being performed). The sensor 246 as illustrated is intended to show an assembly that includes actuators that move the sensor 246 toward and away from the sheet transport elements 250.

Figure 4B:
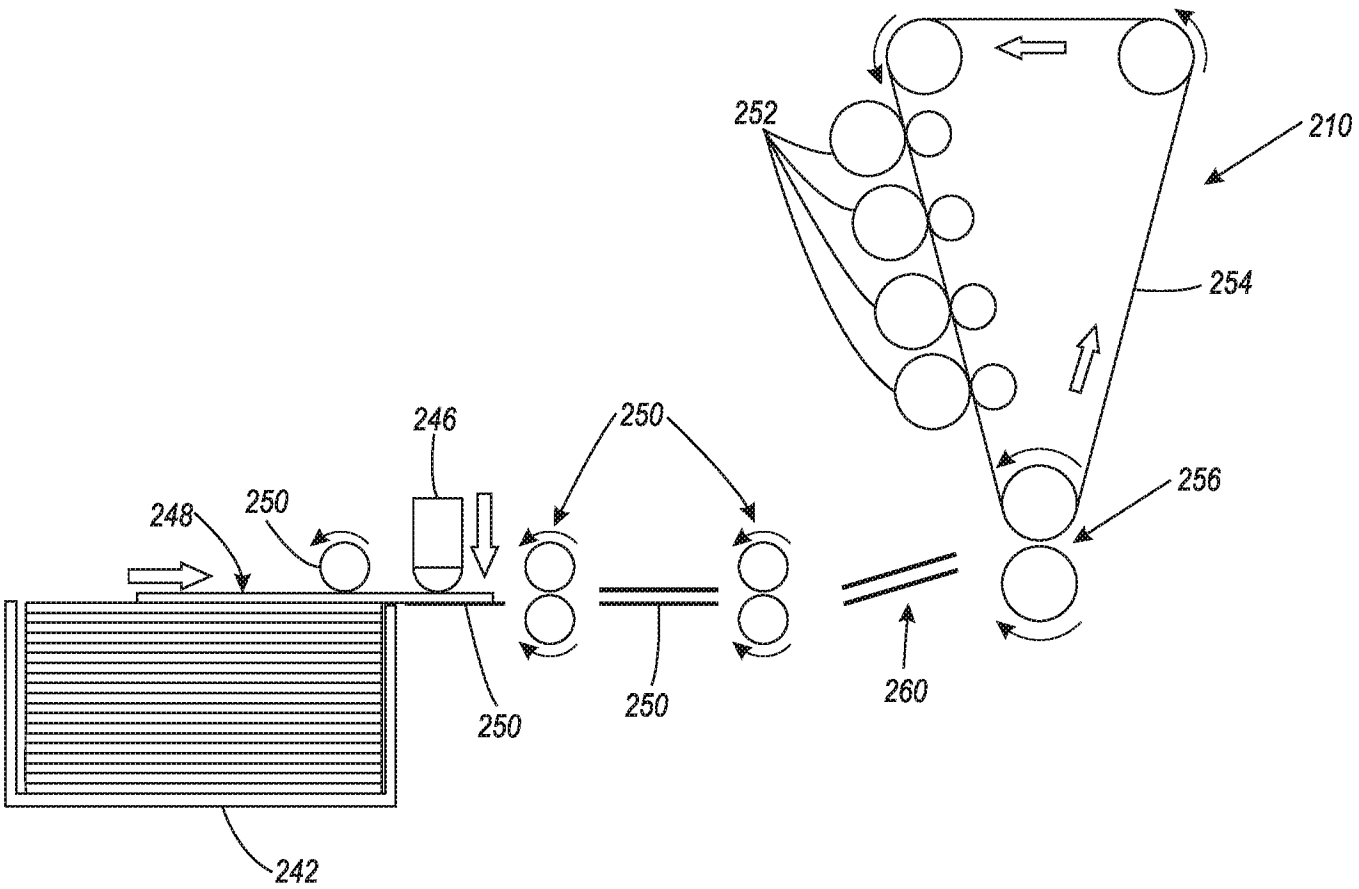

As shown in FIG. 4B, before printing and when performing beam strength testing, the actuators of the sensor 246 move the sensor 246 toward the line formed by the aligned sheet transport elements 250 so that the sensor 246 is aligned with such sheet transport elements 250. Also, the sheet transport elements 250 (rollers, nips, belts, baffles, etc.) move the sheet being tested partially from the storage container to move across the sensor 246 (e.g., move the sheet 1-5 cm, or 5-25% of the sheet length, etc.) to allow the force gauge 246 to contact the top sheet 248. In other words, the top sheet 248 is not fully removed from the storage container/compartment 242, but is only moved enough to allow the sheet 248 to make contact with the sensor 246 when the sensor is extended toward the sheet transport elements 250. Thus, the distance that the sheet is moved from the storage container 242 will depend upon how far the sensor 246 is positioned from the storage container 242, and how far the sheet 248 is to move across the projection or roller of the sensor 246 (how much of the length of the sheet will be used for force detection: e.g., 10%, 25%, 50%, etc. of the sheet length).

The force sensor 246 sends data regarding how much force was applied to, or received from, the sheet 248, how much the sheet 248 deformed, the extent and direction of any sheet curvature, etc., to the processor 224 to allow the processor to calculate the beam strength and the curvature amount and direction (beam strength and curl characteristics signature profile). The processor 224 can include other measures (paper type, paper weight, paper thickness, environmental conditions (including current temperature and humidity from sensor 232), etc.) in addition to the force measurements from the force sensor 246, when calculating the beam strength and curl characteristics signature profile. Therefore, the force sensor 246 can be the only device that provides beam strength and curvature, or such can be calculated using many inputs including media type, media weight, humidity, force measurements from the force sensor 246, etc.

Figure 4C:
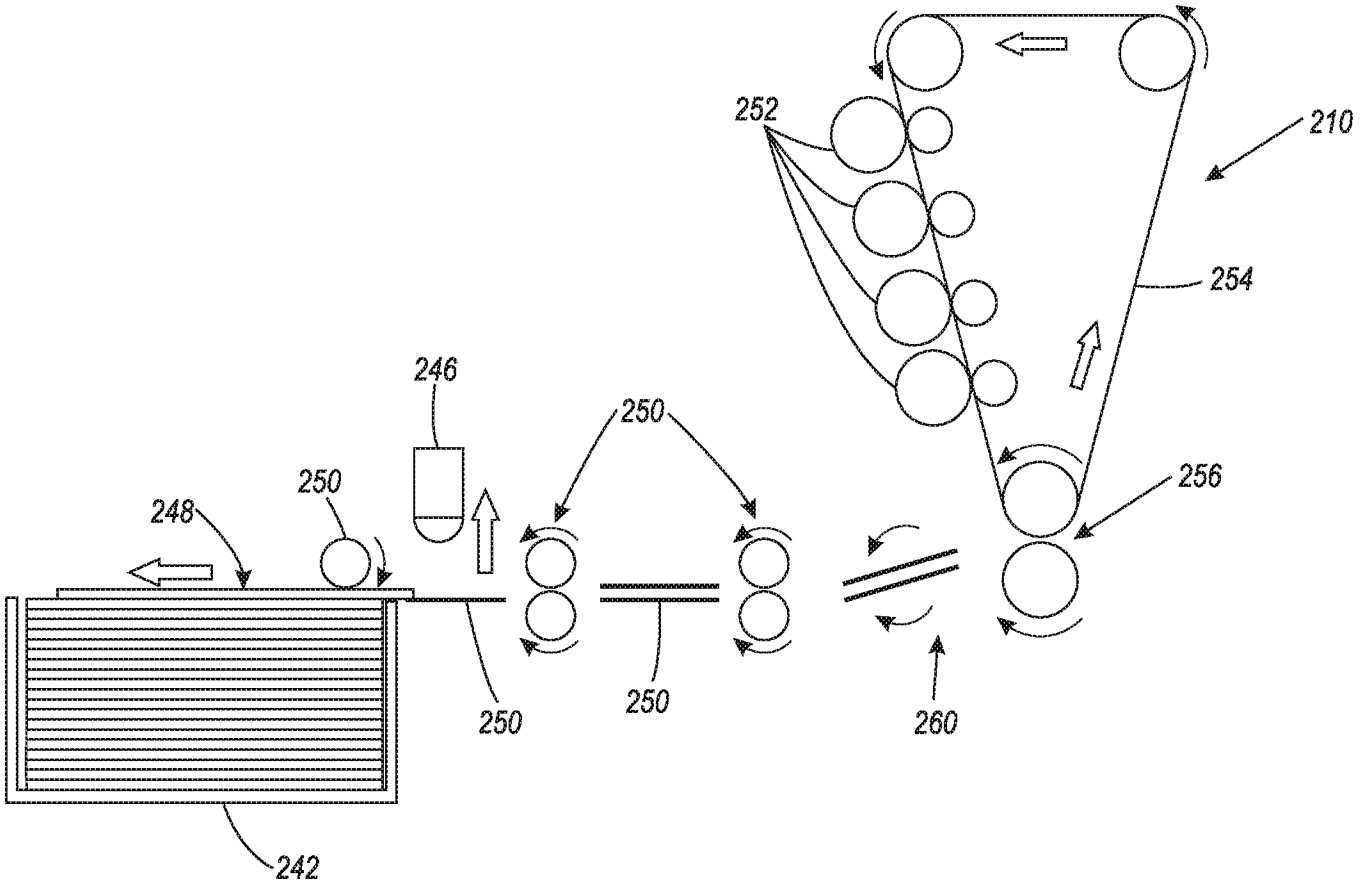

As shown in FIG. 4C, after the beam strength and curl characteristics signature profile has been determined, the sheet transport elements 250 move the sheet being tested 248 back to the storage container 242, and the actuators of the sensor 246 retract the sensor 246 away from the sheet transport elements 250.

Figure 4D:
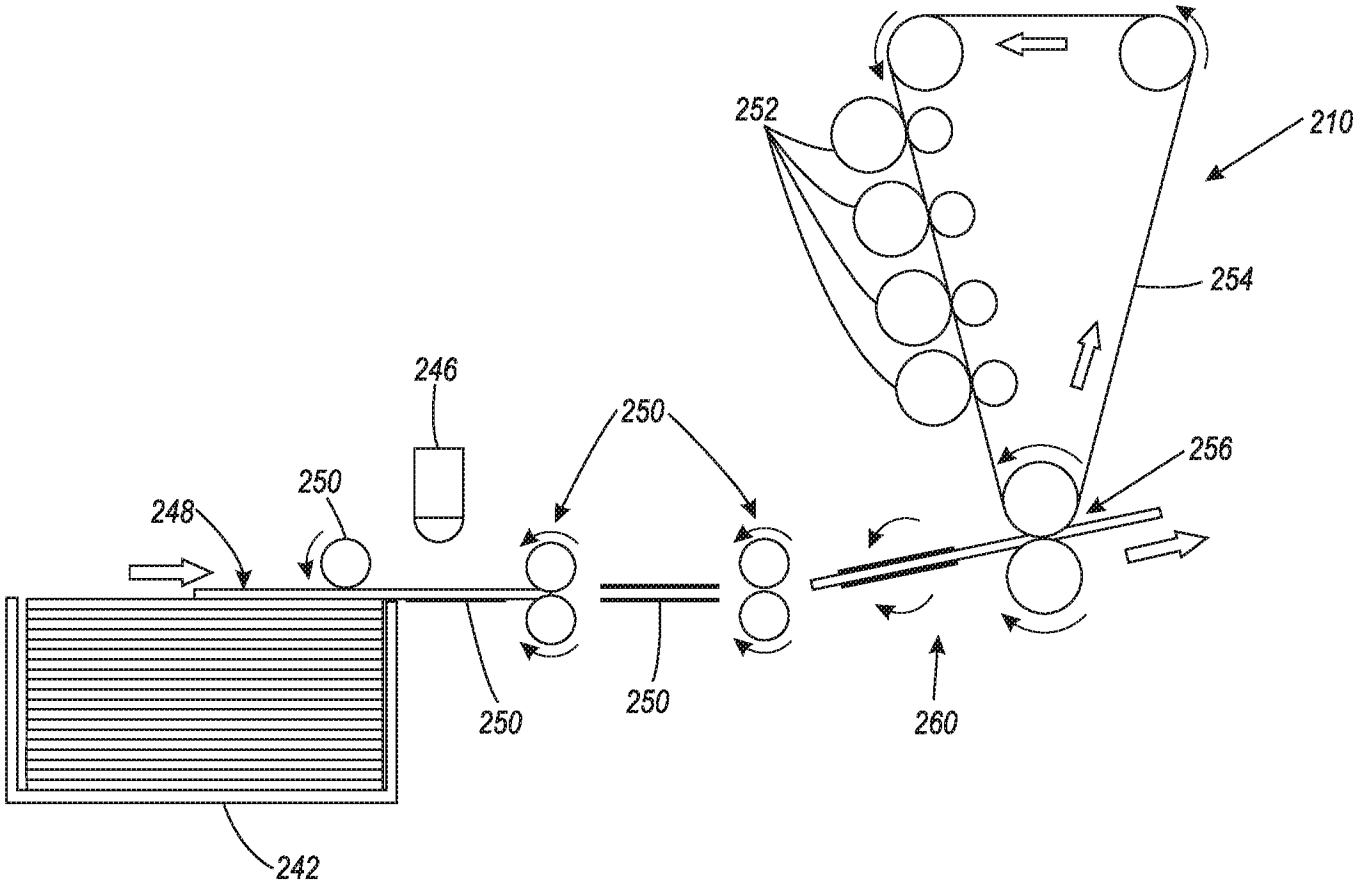

After such processing in FIGS. 4B and 4C, printing can commence, as shown in FIG. 4D. Therefore, in FIG. 4D the force sensor 246 is fully retracted (where "retracted" means in a position that is moved away from the line created by the sheet transport elements 250 (and "extended" means the opposite)) when sheets 248 move along the sheet transport elements 250 from the storage container 242 to the transfer nip 256.

Positioning the sensor 246 outside the line of the sheet transport elements 250 during printing allows the sheets 248 to move by the sensor 246 unobstructed, and on to the transfer nip 256 to receive markings during printing operations, as shown in FIG. 4D. As also shown in FIG. 4D, the angle of the adjustable baffle 260 is adjusted to change the angle at which the sheet 248 enters the transfer nip 256, and/or adjust the buckle of the sheet 248 as it enters the transfer nip 256. The angle or sheet buckle of the sheet 248 entering the transfer nip 256 is adjusted based on the sheet thickness, weight, beam strength, curl, etc., to prevent paper jams, to ensure proper alignment of the sheet, to prevent sheet folding, to ensure proper engagement of the sheet in the transfer nip 256, etc.

By determining the beam strength and curl of the sheet 248 as the last step before beginning printing using the force sensor 246 (and potentially independently of the paper weight, measured humidity, etc.) the devices and methods herein can more accurately adjust the manner in which the sheet transport elements 250 contact the sheets 248, and the angle at which the adjustable baffle 260 directs the sheets 248 into the transfer nip 256, thereby improving print quality, and decreasing paper jams and folds.

Figure 4E:
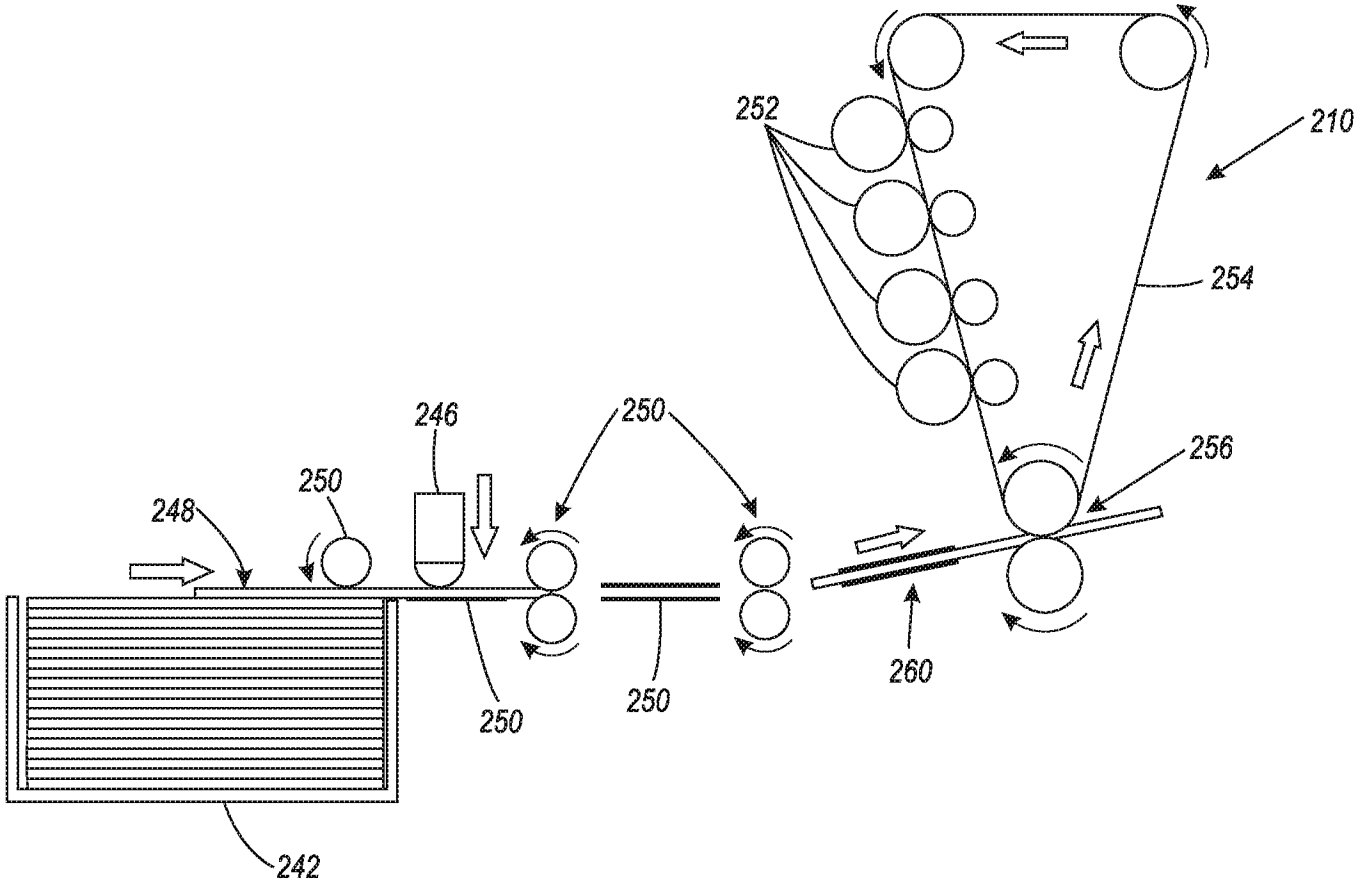

Therefore, in the configuration shown in FIG. 4D, the force sensor 246 does not contact the sheets 248 moving along the sheet transport elements 250 during printing operations so as to not induce any deformations into the sheets 248. In other situations, as shown in FIG. 4E, the force sensor 246 can remain aligned with the sheet transport elements 250 during printing to allow a continuous beam strength and curl characteristics signature profile to be calculated by detecting the deformation forces of each sheet as they are retrieved from the storage container 242 during printing operations.

Figure 5A:
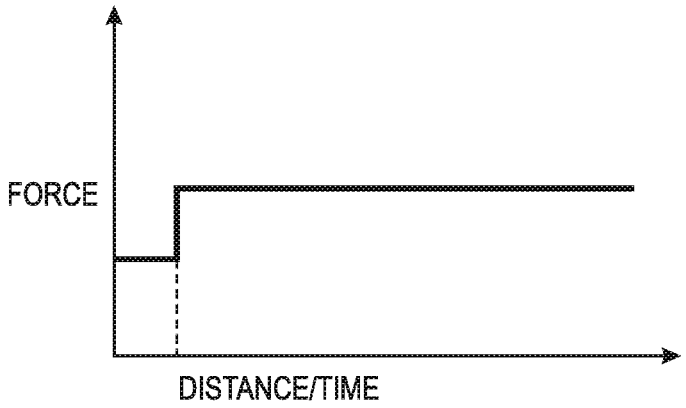
FIGS. 5A-5C are graphs illustrating the forces processed by the devices herein.
Figure 5B:
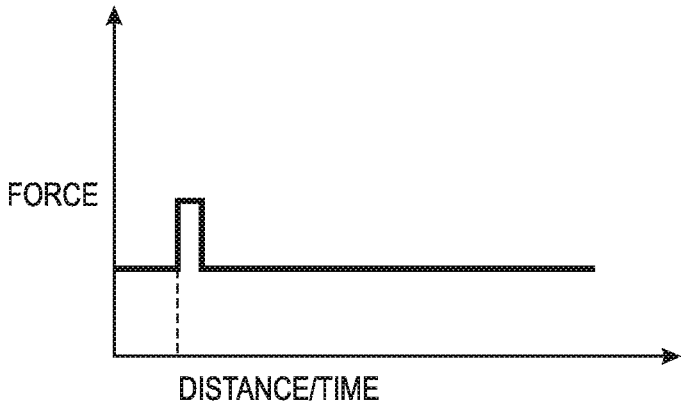
Figure 5C:
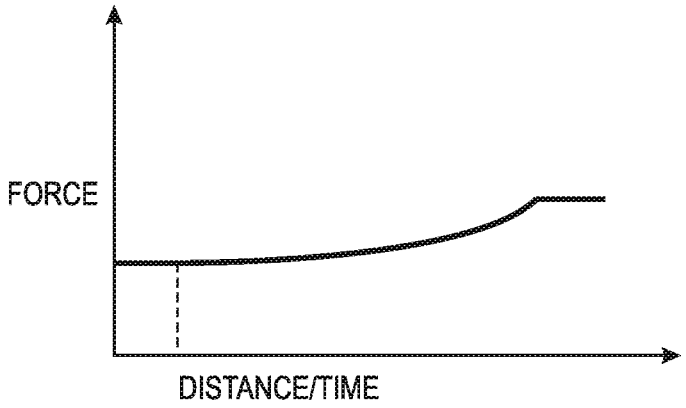

FIGS. 5A-5C are graphs showing the amount of force sensed by the force sensor 246 over time or distance measures as the sheet 248 passed by the sensor 246 while contacting the sensor 246 (with the dashed line indicating when the sheet 248 first contacts the sensor 246. FIG. 5A illustrates a force pattern that the processor 224 would recognize as a sheet that has negligible paper curl, because in FIG. 5A the force measurement dramatically increases as the sensor contacts the leading edge of the sheet, and the force measurement remains high after that point. FIG. 5B illustrates a force pattern that the processor 224 would recognize as a sheet that has concave paper curl (upward curl) where the force measurement initially dramatically increases as the sensor contacts the leading edge of the sheet, but then dramatically decreases (indicating curl toward the sensor). FIG. 5C illustrates a force pattern that the processor 224 would recognize as a sheet that has convex paper curl (downward curl) where the force measurement gradually increases after the sensor contacts the leading edge of the sheet, and then remains high after reaching full force (indicating curl away from the sensor).

Figure 6:
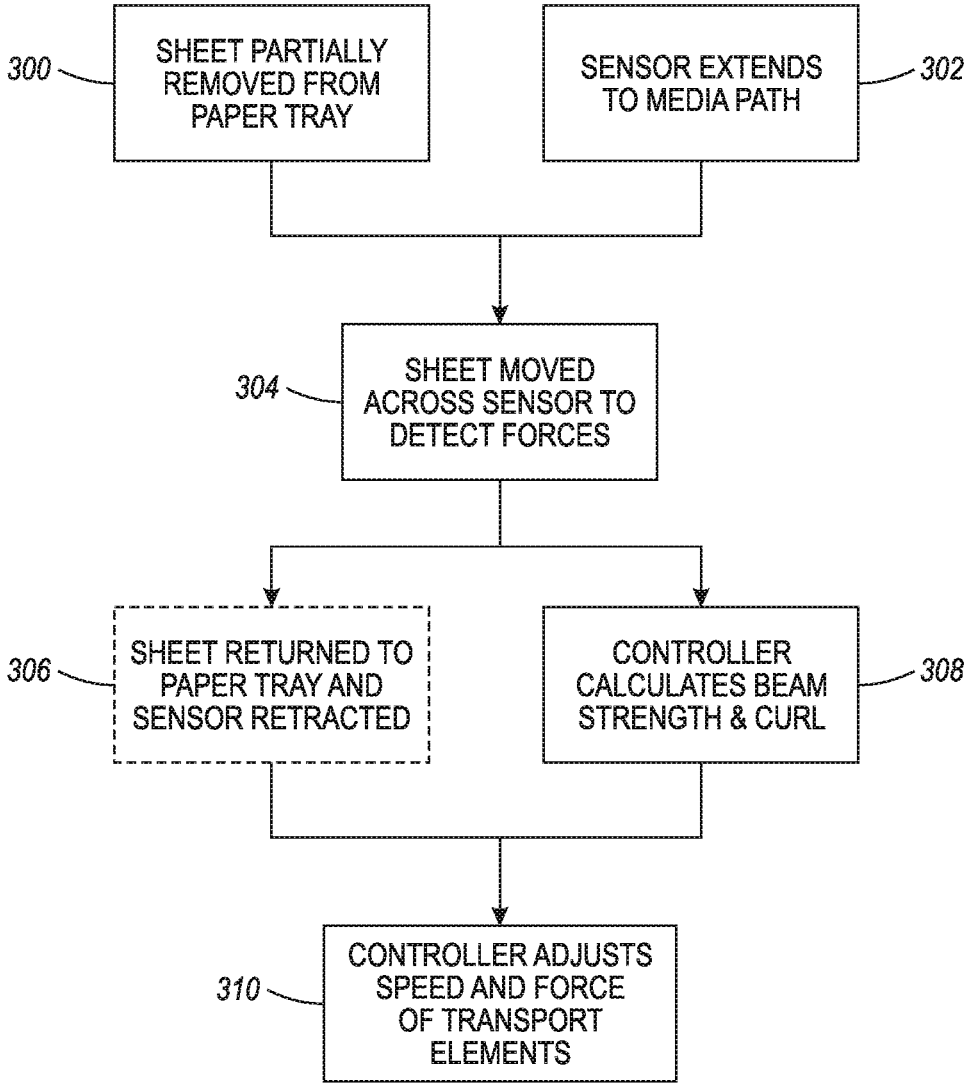
FIG. 6 is a flow diagram of various methods herein.

FIG. 6 is a flowchart showing the processing illustrated and discussed above. More specifically, in item 300, the sheet transport elements automatically partially remove a sheet of media from the storage container storing the sheets of media, and at the same time in item 302, the sensor automatically moves to contact the sheet while the sheet is held by the sheet transport elements (and is partially removed from the storage container). In item 304, the sensor automatically detects forces from the sheet contacting the sensor while the sheet transport elements move a portion of the sheet past the sensor (the sensor deforms the sheet when detecting the forces). Thus, in item 304, the sensor is extended to be aligned with the sheet transport elements when the sensor detects the forces; however, in item 306, the sensor can automatically move back to its retracted position to not be aligned with the sheet transport elements after the sensor detects the forces. Also, the sensor may detect the forces of only one of the sheets in the storage container in item 304. At the same time in item 306, the sheet transport elements automatically return the sheet to the storage container (after the sensor detects the forces). Simultaneously, in item 308, the processor automatically determines the beam strength and curl characteristics signature profile of the sheets based on the forces detected by the sensor.

In item 310, printing operations are automatically performed and the sheet transport elements transport the sheets from the storage container to the transfer nip of the printing engine after the sheet transport elements return the sheet to the storage container in item 306. In some situations, processing in item 306 can be omitted, and the sensor can remain aligned with the sheet transport elements during printing to allow a continuous beam strength and curl characteristics signature profile to be detected.

For example, in item 310, the sheet transport elements can automatically adjust the angle at which the sheet transport elements direct the sheets into the transfer nip, as controlled by the processor, based on the beam strength and curl characteristics signature profile calculated in item 308. Further, in item 310, the sheet transport elements can also automatically adjust the speed of, and force applied by, the sheet transport elements, as controlled by the processor, based on the beam strength and curl characteristics signature profile.

While some exemplary structures are illustrated in the attached drawings, those ordinarily skilled in the art would understand that the drawings are simplified schematic illustrations and that the claims presented below encompass many more features that are not illustrated (or potentially many less) but that are commonly utilized with such devices and systems. Therefore, Applicants do not intend for the claims presented below to be limited by the attached drawings, but instead the attached drawings are merely provided to illustrate a few ways in which the claimed features can be implemented.

Many computerized devices are discussed above. Computerized devices that include chip-based central processing units (CPU's), input/output devices (including graphic user interfaces (GUI), memories, comparators, tangible processors, etc.) are well-known and readily available devices produced by manufacturers such as Dell Computers, Round Rock Tex., USA and Apple Computer Co., Cupertino Calif., USA. Such computerized devices commonly include input/output devices, power supplies, tangible processors, electronic storage memories, wiring, etc., the details of which are omitted herefrom to allow the reader to focus on the salient aspects of the systems and methods described herein. Similarly, printers, copiers, scanners and other similar peripheral equipment are available from Xerox Corporation, Norwalk, Conn., USA and the details of such devices are not discussed herein for purposes of brevity and reader focus.

The terms printer or printing device as used herein encompasses any apparatus, such as a digital copier, bookmaking machine, facsimile machine, multi-function machine, etc., which performs a print outputting function for any purpose. The details of printers, printing engines, etc., are well-known and are not described in detail herein to keep this disclosure focused on the salient features presented. The systems and methods herein can encompass systems and methods that print in color, monochrome, or handle color or monochrome image data. All foregoing systems and methods are specifically applicable to electrostatographic and/or xerographic machines and/or processes.

In addition, terms such as "right", "left", "vertical", "horizontal", "top", "bottom", "upper", "lower", "under", "below", "underlying", "over", "overlying", "parallel", "perpendicular", etc., used herein are understood to be relative locations as they are oriented and illustrated in the drawings (unless otherwise indicated). Terms such as "touching", "on", "in direct contact", "abutting", "directly adjacent to", etc., mean that at least one element physically contacts another element (without other elements separating the described elements). Further, the terms automated or automatically mean that once a process is started (by a machine or a user), one or more machines perform the process without further input from any user. In the drawings herein, the same identification numeral identifies the same or similar item.

It will be appreciated that the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims. Unless specifically defined in a specific claim itself, steps or components of the systems and methods herein cannot be implied or imported from any above example as limitations to any particular order, number, position, size, shape, angle, color, or material.

What is claimed is:

1. A printer comprising:

a storage container shaped to store sheets of print media;

sheet transport elements positioned to transport said sheets from said storage container;

a sensor detecting forces while contacting one of said sheets; and a processor electrically connected to said sensor and said sheet transport elements, said processor determining a beam strength and curl characteristics signature profile of said one of said sheets based on said forces detected by said sensor, and said processor adjusts how said sheet transport elements contact said sheets based on said beam strength and curl characteristics signature profile.

2. The printer according to claim 1, said sheet transport elements move said one of said sheets from said storage container to said sensor before said sensor detects said beam strength and curl characteristics signature profile, and said sheet transport elements move said one of said sheets back to said storage container after said sensor detects said beam strength and curl characteristics signature profile.

3. The printer according to claim 1, said sensor is not aligned with said sheet transport elements when said printer is printing on said sheets.

4. The printer according to claim 1, said sensor is aligned with said sheet transport elements when said printer is printing on said sheets.

5. The printer according to claim 1, said sensor detects said beam strength and curl characteristics signature profile of only the top sheet of said sheets in said storage container.

6. The printer according to claim 1, said sensor comprises a roller pressing against said one of said sheets to detect force used to deform said one of said sheets.

7. The printer according to claim 1, said beam strength and curl characteristics signature profile change based on humidity.

8. A printer comprising:

a storage container shaped to store sheets of print media;

a printing engine positioned to receive said sheets from said storage container, said printing engine having a transfer nip;

sheet transport elements positioned to transport said sheets from said storage to said transfer nip;

a sensor detecting forces while contacting one of said sheets; and a processor electrically connected to said sensor and said sheet transport elements, said processor determining a beam strength and curl characteristics signature profile of said one of said sheets based on said forces detected by said sensor, said processor adjusts an angle at which said sheet transport elements direct said sheets into said transfer nip based on said beam strength and curl characteristics signature profile.

9. The printer according to claim 8, said sheet transport elements move said one of said sheets from said storage container to said sensor before said sensor detects said beam strength and curl characteristics signature profile, and said sheet transport elements move said one of said sheets back to said storage container after said sensor detects said beam strength and curl characteristics signature profile.

10. The printer according to claim 8, said sensor is not aligned with said sheet transport elements when said printer is printing on said sheets.

11. The printer according to claim 8, said processor adjusts a speed of, and force applied by, said sheet transport elements based on said beam strength and curl characteristics signature profile.

12. The printer according to claim 8, said sensor detects said beam strength and curl characteristics signature profile of only the top sheet of said sheets in said storage container.

13. The printer according to claim 8, said sensor comprises a roller pressing against said one of said sheets to detect force used to deform said one of said sheets.

14. The printer according to claim 8, said beam strength and curl characteristics signature profile change based on humidity.

15. A method of a sheet transport control system for a printer comprising steps of comprising:

automatically moving a sensor to sheet transport elements;

automatically, by said sheet transport elements, partially removing a sheet of media from a storage container storing sheets of media;

automatically, by said sensor, detecting forces from said sheet contacting said sensor while said sheet transport elements move a portion of said sheet past said sensor;

automatically, by said sheet transport elements, returning said sheet to said storage container after said sensor detects said forces;

automatically, by a processor, determining a beam strength and curl characteristics signature profile of said sheets based on said forces detected by said sensor;

automatically, by said sheet transport elements, transporting said sheets from said storage container to a printing engine having a transfer nip after said sheet transport elements return said sheet to said storage container; and automatically, by said sheet transport elements, adjusting an angle at which said sheet transport elements direct said sheets into said transfer nip, as controlled by said processor, based on said beam strength and curl characteristics signature profile.

16. The method according to claim 15, further comprising automatically, by said sheet transport elements, adjusting a speed of, and force applied by, said sheet transport elements, as controlled by said processor, based on said beam strength and curl characteristics signature profile.

17. The method according to claim 15, said sensor is aligned with said sheet transport elements when said sensor detects said forces.

18. The method according to claim 15, further comprising automatically, by SAID sensor, moving said sensor to not be aligned with said sheet transport elements after said sensor detects said forces.

19. The method according to claim 15, said sensor detects said forces of only one of said sheets in said storage container.

20. The method according to claim 15, said sensor deforms said sheet when detecting said forces.

* * * * *